US011421335B2

(12) United States Patent
Schramek et al.

(10) Patent No.: US 11,421,335 B2
(45) Date of Patent: Aug. 23, 2022

(54) ELECTROLYTE FOR THE DEPOSITION OF ANTHRACITE/BLACK RHODIUM/RUTHENIUM ALLOY LAYERS

(71) Applicant: Umicore Galvanotechnik GmbH, Schwaebisch Gmuend (DE)

(72) Inventors: Philip Schramek, Lorch (DE); Martin Stegmaier, Kieselbronn (DE)

(73) Assignee: Umicore Galvanotechnik GmbH, Schwaebisch Gmuend (DE)

( * ) Notice: Subject to any disclaimer, the term of this patent is extended or adjusted under 35 U.S.C. 154(b) by 0 days.

(21) Appl. No.: 17/433,215

(22) PCT Filed: Apr. 7, 2020

(86) PCT No.: PCT/EP2020/059865

§ 371 (c)(1),
(2) Date: Aug. 23, 2021

(87) PCT Pub. No.: WO2020/208004

PCT Pub. Date: Oct. 15, 2020

(65) Prior Publication Data

US 2022/0136124 A1 May 5, 2022

(30) Foreign Application Priority Data

Apr. 8, 2019 (DE) ..... 102019109188.8

(51) Int. Cl.
*C25D 3/52* (2006.01)
*C25D 5/00* (2006.01)
(Continued)

(52) U.S. Cl.
CPC ..... *C25D 3/50* (2013.01); *C25D 5/48* (2013.01)

(58) Field of Classification Search
CPC ... C25D 5/00; C25D 5/10; C25D 5/48; C25D 5/56; C25D 5/627; C25D 3/52; C25D 3/567
(Continued)

(56) References Cited

U.S. PATENT DOCUMENTS 3,692,641 A * 9/1972 Losi et al. ..... C25D 3/567 205/257
3,890,210 A 6/1975 Stevens
(Continued)

FOREIGN PATENT DOCUMENTS

DE 1959907 6/1970
DE 2429275 1/1975
(Continued)

OTHER PUBLICATIONS

International Search Report received in PCT/EP2020/059865, dated Jun. 4, 2020.
(Continued)

*Primary Examiner* — Edna Wong
(74) *Attorney, Agent, or Firm* — Suzannah K. Sundby, Esq.; Canady + Lortz LLP

(57) ABSTRACT

The present invention is directed toward an electrolyte which allows for electrolytically producing a black metal layer consisting of rhodium and ruthenium. The present invention also relates to a method for producing a corresponding article, and to the use of the electrolyte.

12 Claims, 2 Drawing Sheets

(51) Int. Cl.
*C25D 5/10* (2006.01)
*C25D 5/48* (2006.01)
*C25D 3/50* (2006.01)

(58) Field of Classification Search
USPC ..... 205/176, 220, 257, 258, 259
See application file for complete search history.

(56) References Cited

U.S. PATENT DOCUMENTS

| | | | | |
|---|---|---|---|---|
| 4,402,802 | A | 9/1983 | Kreuter | |
| 4,477,318 | A * | 10/1984 | Tomaszewski | C25D 21/18 205/101 |
| 2008/0226545 | A1 | 9/2008 | Bull | |

FOREIGN PATENT DOCUMENTS

| | | | | |
|---|---|---|---|---|
| DE | 102011115802 | | 4/2013 | |
| EP | 0171091 | | 2/1986 | |
| JP | 57101686 | A * | 6/1982 | C25D 3/56 |
| JP | S57101686 | | 6/1982 | |
| JP | S6184392 | | 4/1986 | |
| JP | S6184393 | | 4/1986 | |
| JP | S61104097 | | 5/1986 | |
| JP | H04154988 | | 5/1992 | |
| WO | 2008116545 | | 10/2008 | |
| WO | 2010057573 | | 5/2010 | |
| WO | 2012171856 | | 12/2012 | |
| WO | 2015173186 | | 11/2015 | |
| WO | 2018142430 | | 8/2018 | |
| WO | WO-2018142430 | A1 * | 8/2018 | C25D 3/52 |

OTHER PUBLICATIONS

"https://en.wikipedia.org/w/index.php?title=Anodizing&oldid=888700538", "Anodizing", Apr. 9, 2019, Publisher: Wikipedia.
Cobley et al., "The use of Insoluble Anodes in Acid Sulphate Copper Electrodeposition Solutions", 2001, pp. 112-118, vol. 79, No. 3, Publisher: Transactions of the IMF.
"https://ep.umicore.com/en/products/productfinder", "Umicore—Productfinder", Apr. 9, 2019, Publisher: Umicore Electroplating.
"https://de.wikipedia.org/wiki/Lab-Farbraum", "Lab Color Space", Aug. 9, 2021, Publisher: Wikipedia.
"Rhoduna(R) 470 Black Rhodium Elektrolyt", Apr. 9, 2019, Publisher: Umicore Electroplating.
Bosch-Weinmann, "Abriebprufgerat Erichsen Typ 317", 1959, pp. 647-651, vol. 65, Publisher: Farbe und Lack.
Written Opinion received in PCT/EP2020/059865, dated Jun. 4, 2020.

* cited by examiner

ELECTROLYTE FOR THE DEPOSITION OF ANTHRACITE/BLACK RHODIUM/RUTHENIUM ALLOY LAYERS

The present invention is directed towards an electrolyte which makes it possible to electrolytically produce a black metal layer consisting of rhodium and ruthenium. A method for producing a corresponding article, and the use of the electrolyte, are likewise the subject matter of the present invention.

Consumer goods and technical articles, pieces of jewelry, and decorative goods are finished with thin, oxidation-stable metal layers to protect them against corrosion and/or for optical enhancement. These layers must be mechanically stable and should not show any discoloration or signs of wear even in the event of prolonged use. An effective means for producing such layers are galvanic methods with which a plurality of high-quality metal and alloy layers may be obtained. Examples that are well known in everyday life are galvanic bronze and brass layers on door latches or doorknobs, chromium coatings of vehicle parts, galvanized tools, or gold coatings on watch straps.

A particular challenge in the field of galvanic finishing is the generation of oxidation-stable, electrically conductive, and mechanically resilient metal layers in the color black, which may be of interest not only in the decorative and jewelry sector but also for technical applications, for example in the field of solar technology or as a contact material. Only a few metals are available for producing oxidation-stable black layers. In addition to ruthenium, rhodium, palladium, chromium and nickel are also suitable. The use of the noble metal rhodium is limited to the jewelry sector because of the high raw material costs. The use of low-cost nickel and nickel-containing alloys, especially in the jewelry and consumer goods sector, is possible only in exceptional cases and when observing strict requirements, since nickel and nickel-containing metal layers are contact allergens.

The electrodeposition of black ruthenium layers (black ruthenium) on electrically conductive substrates is best known (DE102011115802A1, WO2012171856A2, WO2008226545A1, and literature cited therein). It is also possible to electrolytically produce black deposits of rhodium (black rhodium) (EP171091A2, JP4154988A2, JP61104097A2, JP61084393A2, JP61084392A2; https://ep.umicore.com/de/produkte-3/produktfinder/rhoduna-470-black-rhodium-elektrolyt-/—Rhoduna® 470 Black).

The electrodeposition of rhodium-ruthenium metal layers has already been described, for example in DE2429275A and WO2010057573A1. In JPS57101686A, an electrolyte is described with which metal layers of rhodium and ruthenium can be obtained which, depending on conditions, may be dark blue, gray, or black. However, the layers produced with the electrolytes mentioned here do not have the blackness or abrasion resistance required by the market.

It was therefore still an object to specify possibilities for improved metal deposition that better correspond to the requirements of the market participants. In particular, it should be possible to produce metal layers with an attractive black hue, with/or without a blue tone, reproducibly, in a simple and cost-effective manner. The obtained metal layers should be as free of cracks and abrasion-resistant as possible in order to be able to serve as contact materials, decorative metal articles, in particular as jewelry pieces. It should be possible to implement the deposition in an accordingly effective manner for an industrial process.

In that an aqueous, acidic electrolyte is provided to produce dark metal layers on conductive materials, having:

- 0.5-15.0 g/l of a soluble rhodium compound (in relation to the metal);
- 0.5-10.0 g/l of a soluble ruthenium compound (in relation to the metal);
- 5-150 g/l of an acid;
- a phosphonic acid and a dicarboxylic acid;

the posed object is achieved.

The electrolyte according to the invention as presented here allows for the electrodeposition of a metal layer on electrically conductive materials, wherein the metal layer has an extremely high abrasion resistance given good electrical conductivity, and is thus predestined for use in contact materials. Likewise, the appealing, dark, and color-neutral hue of the metal layer is an advantage for use as a decorative element as well. It was not to be expected that this can be achieved with the electrolyte presented here.

Figure 1:
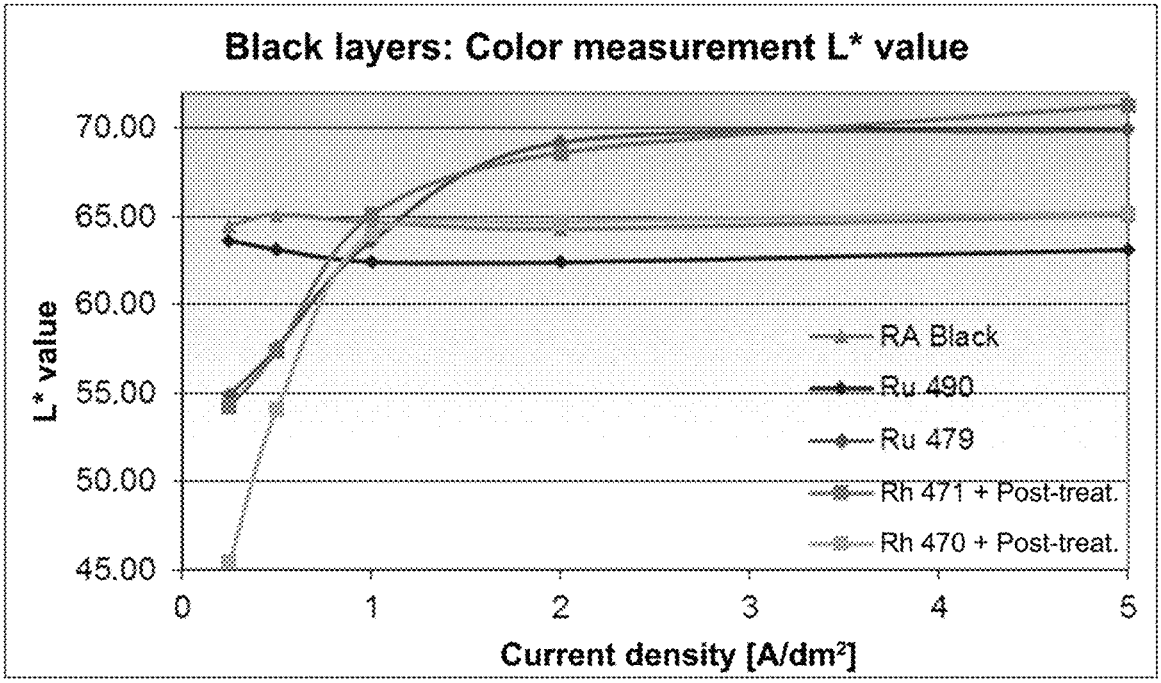
FIG. 1 is a graph showing the L* value of electrolytically deposited metal layers.

All materials which a person skilled in the art would have considered for this purpose are suitable as current-conducting materials onto which a metal layer can be deposited according to the invention. Preferred are those selected from the group consisting of jewelry pieces, bathroom articles, metallic consumer goods in the kitchen and living area, contact materials such as switches, plug connections, relays, and many more.

The rhodium compound to be used in the electrolyte according to the invention can be selected at the discretion of the persons skilled in the art. They will base its selection on the required solubility in the acidic, aqueous electrolyte, the deposition capability in connection with the ruthenium compound that is used, and on the costs for the rhodium compound.

In the electrolyte according to the invention, rhodium is present in the form of its ions in dissolved form. It is preferably introduced in the form of water-soluble salts which are preferably selected from the group of pyrophosphates, carbonates, hydroxide carbonates, hydrocarbonates, sulfites, sulfates, phosphates, nitrites, nitrates, halides, hydroxides, oxide hydroxides, oxides, or combinations thereof. Very particular preference is given to the embodiment in which the metals in the form of the salts with ions are optionally used from the group consisting of pyrophosphate, carbonate, sulfate, hydroxide carbonate, oxide hydroxide, hydroxide, and hydrocarbonate. Absolute preference is given to use in the electrolyte in the form of the salt of a mineral acid such as rhodium sulfate or rhodium phosphate. However, in the baths according to the invention, it can be used also as a salt of an organic acid such as rhodium alkanesulfonate, for example as rhodium methanesulfonate or as rhodium sulfamate, or as a mixture of these compounds. The trivalent rhodium compounds to be used are furthermore very particularly preferably selected from rhodium (III) fluoride, rhodium (III) chloride, rhodium (III) bromide, rhodium (III) iodide, rhodium (III) oxide hydrate, and rhodium (III) sulfate.

The ruthenium compounds to be used in the electrolyte are selected, for example, from ruthenium (III) fluoride, ruthenium (III) chloride, ruthenium (III) bromide, ruthenium (III) iodide, ruthenium (III) nitrosyl nitrate, ruthenium (III) acetate, ruthenium isonitrile complexes, ruthenium nitrido-hydroxo complexes, and ruthenium nitrido-oxalato complexes.

The ruthenium source for the electrolyte according to the invention is more preferably prepared in situ. This then contains ruthenium in complexed form, preferably as a binuclear complex, which is obtainable in aqueous acidic solution based on ruthenium (III) compound, amidosulfuric acid, and/or ammonium sulfamate. Electrolyte baths or preparation concentrates containing 1-10 g/l of amidosulfuric acid and/or ammonium sulfamate per 1 g/l of ruthenium are common. To this end, mixtures containing e.g. ruthenium (III) compounds, amidosulfuric acid, and/or ammonium sulfamate are heated for a certain period of time, whereby the $[Ru_2N(H_2O)_2X_8]^{3-}$ salt is formed (X stands for monovalent anions). Ammonium or sodium or potassium ions may be preferably used as counterions (WO2015173186A1 or WO12171856A2 or WO2008116545A1, and pertinent literature cited therein).

Ruthenium is very particularly preferably used in the form of a binuclear, anionic nitrido-halogeno complex compound of formula $[Ru_2N(H_2O)_2X_8]^{3-}$, with X being a halide ion such as chlorine, bromine, or iodine. In this context, particular preference is given to the chloro complex $[Ru_2N(H_2O)_2Cl_8]^{3-}$.

Which compound of the metals is introduced into the electrolyte in what amount may also be determinative of the color of the resulting coating, and can be adjusted according to customer requirements. As indicated, the metals to be deposited are present in ionically dissolved form in the electrolyte for application of decorative coatings to jewelry articles, consumer goods, and technical articles. Rhodium is preferably present in the electrolyte at a concentration of 1 g/l-10 g/l, more preferably 2 g/l-7 g/l. The ruthenium concentration is preferably 1 g/l-8 g/l, more preferably 2 g/l-6 g/l. The quantities indicated each relate to the amount of metal.

The electrolyte according to the invention functions particularly well within a very acidic pH range. The pH value ranges are specified below. Inorganic acids are preferably used for adjusting the pH value. Alternatively, however, organic acids such as sulfonic acids may also be used for this purpose. Particularly preferably, the acids selected from the group consisting of sulfuric acid, hydrochloric acid, methanesulfonic acid, toluenesulfonic acid, benzenesulfonic acid and sulfuric acid, is most preferably used.

The black coloration of the galvanically produced rhodium-ruthenium layers is achieved by selectively inhibiting the deposition rate from the galvanic bath. As an inhibitor, and thus as a blackening additive for ruthenium in particular, one or more phosphonic acid derivatives are present in the electrolyte according to the invention. Preference is given to using the compounds aminophosphonic acid AP, 1-aminomethylphosphonic acid AMP, aminotris(methylenephosphonic acid) ATMP, 1-aminoethylphosphonic acid AEP, 1-aminopropylphosphonic acid APP, (1-acetylamino-2,2,2-trichloroethyl)phosphonic acid, (1-amino-1-phosphona actyl)phosphonic acid, (1-benzoylamino-2,2,2-trichloroethyl)-phosphonic acid, (1-benzoylamino-2,2-dichlorovinyl)phosphonic acid, (4-chlorophenyl-hydroxymethyl)phosphonic acid, diethylenetriaminepenta (methylenephosphonic acid) DTPMP, ethylene diamine tetra (methylene phosphonic acid) EDTMP, 1-hydroxyethane-(1,1-diphosphonic acid) HEDP, hydroxyethyl-amino-di(methylene phosphonic acid) HEMPA, hexamethylenediamine tetra(methylene phosphonic acid) HDTMP, ((hydroxymethyl phosphonomethyl-amino)-methyl)phosphonic acid, nitrilotris(methylenephosphonic acid) NTMP, 2,2,2-trichloro-1-(furan-2-carbonyl)aminoethylphosphonic acid, salts derived therefrom or condensates derived therefrom, or combinations thereof.

Particular preference is given to using one or more compounds selected from the group consisting of aminotris (methylenephosphonic acid) ATMP, diethylenetriaminepenta (methylenephosphonic acid) DTPMP, ethylene diamine tetra (methylene phosphonic acid) EDTMP, 1-hydroxyethane-(1,1-diphosphonic acid) HEDP, hydroxyethyl-amino-di(methylene phosphonic acid) HEMPA, hexamethylenediamine tetra(methylene phosphonic acid) HDTMP, salts derived therefrom or condensates derived therefrom, or combinations thereof.

Aminotris(methylenephosphonic acid) ATMP, ethylene diamine tetra (methylene phosphonic acid) EDTMP, and 1-hydroxyethane-(1,1-diphosphonic acid) HEDP, and salts derived therefrom or condensates derived therefrom, or combinations thereof, are extraordinarily suitable in particular for the coating of decorative articles and consumer goods.

The amount of phosphonic acids can be selected by the persons skilled in the art. Their decision will be based on the fact that the phosphonic acid(s) show a sufficient and commensurate effect in the sense of the invention. The phosphonic acids are preferably used in an amount of 0.5-20 g/l in the electrolyte. More preferred are 1-10 g/l, and most preferred are 1-5 g/l in this context.

Dicarboxylic acids, which serve as a blackening additive for rhodium deposits in particular, are also present in the electrolyte. Suitable as dicarboxylic acids are all acids which are opportune to the person skilled in the art for the mentioned purpose, in particular those which are available at low cost and dissolve to a sufficient extent in the aqueous, acidic electrolyte. These may be alkyl, alkenyl dicarboxylic acids or aryl dicarboxylic acids, wherein the acid groups should preferably be capable of forming an internal anhydride. It can be assumed that the two acid groups, together with the metal to be deposited, in particular rhodium, form a bidentate complex compound, wherein a 5- or 6-ring forms with the metal atom. It may come as a surprise that a corresponding complexing takes place at all in the acidic environment, due to the low dissociation of the dicarboxylic acids. Nevertheless, this addition exerts an advantageous effect on the final metal deposition in the sense of the present invention.

Very particular preference is given to aromatic dicarboxylic acids which can form a 5- or 6-ring with the complexed metal atom, and in particular those dicarboxylic acids selected from the group consisting of benzene-, naphthol-, and indenedicarboxylic acids. Phthalic acid and salts thereof are especially preferred.

The amount of dicarboxylic acids can be selected by the persons skilled in the art. Their decision will be based on the fact that the dicarboxylic acid(s) exhibit(s) a sufficient and still commensurate effect in the sense of the invention. The dicarboxylic acids are preferably used in an amount of 0.5-25 g/l in the electrolyte. More preferred are 1-20 g/l, and most preferred are 4-12 g/l in this context.

The present electrolyte is used, in particular, for producing articles having an electrodeposited metal layer comprising the metals rhodium and ruthenium in a wt %-based composition of from 40:60 to 90:10 based on the sum of the weights of both metals, the metal layer having an L* value of less than 65 and an a* value of −3 to +3 according to the Cielab color system (EN ISO 11664-4, effective version as of Apr. 8, 2019). The b* value is advantageously from −7 to +7.

The Cielab color system uses a three-dimensional color space in which the brightness value L* is orthogonal to the color plane (a*,b*). The most important properties of the L*a*b* color model include device independence and perceptual relation, i.e.: colors are defined as perceived by a normal observer under standard light conditions, regardless of the way in which they are generated or rendered. The color model is standardized in EN ISO 11664-4, "Colorimetry—Part 4: CIE 1976 L*a*b* Colour Space". Each color in the color space is defined by a color location with the Cartesian coordinates {L*, a*, b*}. The a*b* coordinate plane was constructed based on the complementary color theory. Green and red are situated opposite one another on the a* axis; the b* axis extends between blue and yellow. Complementary hues are in each case 180° opposite; gray is in their center (the coordinate origin a*=0, b*=0). The L* axis describes the brightness (luminance) of the color with values from 0 to 100. In the illustration, this is at the zero point orthogonal to the a*b* plane. It can also be referred to as the neutral gray axis, as all achromatic colors (gray tones) are contained between the end points of black (L*=0) and white (L*=100). The a* axis describes the green or red portion of a color, wherein negative values stand for green and positive values for red. The b* axis describes the blue or yellow portion of a color, wherein negative values stand for blue and positive values for yellow.

As stated, the present electrolyte can be used to produce reproducibly dark to black layers, possibly with a distinctive blue tone, which with respect to abrasion resistance and hue best satisfy the requirements of the market in the consumer goods and jewelry sector. As regards the b* value, it should be noted that this should not deviate too much from zero in order to achieve distinct black and cool tones. The b* values in the present article are advantageously between −5 and +5, preferably between −3 and +3, and particularly preferably between −2 and +2. A preferred L* value is a value of less than 65, and very preferably less than 60. The L* value should be kept as low as possible. As regards the a* value, values between −2 and +2, and very preferably between −1 and +1, are advantageously achieved.

The composition of the electrodeposited metal layer may vary within the limits of the claims. The person skilled in the art can, for example, control the amount based on the content of the metals in the electrolyte. The decision of the person skilled in the art will be oriented toward the intended use of the deposited metal layer. The electrodeposited metal layer preferably has a composition of from 55:45 to 90:10, very preferably of from 70:30 to 80:20, with respect to the metals Rh and Ru.

The thickness of the metal layer deposited with the electrolyte according to the invention can be determined by the person skilled in the art based on their respective requirement profile. Normally, the thickness will range from 0.5-1.5, preferably from 0.25-0.75, and very preferably from 0.1-0.5 μm. It should be mentioned that, with the electrolyte according to the invention, correspondingly thick layers can also be electrodeposited without cracking occurring in the metal deposition. This is very surprising since, given anthracite/black layers, the brittle rhodium already tends to such cracking during electrodeposition.

For certain applications, it has proven to be advantageous to electrolytically apply a thin top layer of black rhodium onto the metal layer deposited with the electrolyte according to the invention. A possibly thicker metal deposition, which is deposited with the electrolyte according to the invention, therefore preferably subsequently serves as the sublayer for a further electrodeposited metal layer of rhodium, the latter having a thickness of 0.005-1 μm, preferably 0.025-0.75, and very preferably 0.05-0.5 μm. This final black rhodium layer can be implemented with known electrolytes (JP4154988A2, JP61104097A2, JP61084393A2, JP61084392A2; https://ep.umicore.com/de/produkte-3/produktfinder/rhoduna-470-black-rhodium-elektrolyt-/—Rhoduna® 470 Black). It is thus possible to more cost-effectively obtain articles having an even darker metal layer with corresponding abrasion resistance and without cracking, which was extremely surprising. Therefore, the subject matter of the present invention may also be correspondingly produced articles having a sublayer deposited according to the invention, comprising the metals rhodium and ruthenium in a wt %-based composition of from 40:60 to 90:10, based on the sum of the weights of both metals and an electrodeposited top layer of preferably only black rhodium. Preferred L* values of less than 50, more preferably less than 47, result for the layer sequence mentioned above. The values for a* are from −2 to +3, very preferably from 0 to +2, most preferably 0-+1. The values for b* are from −1 to +6, very preferably from 1.5 to +4. The preferred characteristics for the sublayer as specified above also apply, mutatis mutandis, to the layer combination considered here.

It has been found that the metal depositions discussed herein (both for the Rh/Ru layer and for the layer sequence) have a very high abrasion resistance, which is particularly advantageous both for the jewelry sector and for technical applications (for example as a contact material). In what is known as the Bosch-Weinmann-test (Bosch-Weinmann, A. M. Erichsen GmbH, publication 317/D-V/63, or Weinmann K., Farbe and Lack 65 (1959), pp. 647-651), the metal depositions achieve values of less than 2.0 μm/1000 strokes with the electrolyte according to the invention. More advantageously, even less than 1.0 μm/1000 strokes and very advantageously less than 0.75 μm/1000 strokes are achievable. For such abrasion-resistant metal depositions, the composition of the rhodium-ruthenium layer is more preferably from 50:50 to 80:20, most preferably from 60:40 to 80:20.

The subject matter of the present invention is also a method for electrodepositing a metal layer on a conductive material, wherein:

a) the conductive material as a cathode is contacted with an aqueous, acidic electrolyte according to the invention;

b) an anode is contacted with the electrolyte; and c) a sufficient current flow is established between cathode and anode.

It should be noted that the embodiments mentioned as preferable for the electrolyte and its use also apply, mutatis mutandis, to the method addressed here. The current density which is established in the electrolyte between the cathode and the anode during the deposition process can be selected by the person skilled in the art according to the efficiency and quality of deposition. Depending on the application and coating plant type, the current density in the electrolyte is advantageously set to 0.1 to 50 A/dm$^2$. If necessary, current densities can be increased or reduced by adjusting the system parameters, such as the design of the coating cell, flow rates, the anode or cathode conditions, and so on. A current density of 0.2-25 A/dm$^2$ is typically advantageous, preferably 0.25-15 A/dm$^2$, and particularly preferably 0.25-10 A/dm$^2$. Most preferably, the current density is within 0.5-6 A/dm$^2$.

Typically, thin layer thicknesses in a range from 0.1 to 0.3 μm are produced in rack operation. Low current densities in a range from 0.25 to 5 A/dm$^2$ are hereby used. A further application of low current densities is used in the drum or vibration technique, for example when coating contact pins. Here, approximately 0.25 to 0.5 μm-thick layers are applied in a current density range from 0.25 to 0.75 A/dm$^2$. Layer thicknesses in a range from 0.1 to 1.0 μm are typically deposited in rack operation, predominantly for decorative applications, with current densities in a range from 0.5 to 5 A/dm$^2$.

Pulsed direct current can also be used instead of direct current. The current flow is thereby interrupted for a certain period of time (pulse plating). In reverse pulse plating, the polarity of the electrodes is changed so that a partially anodic stripping of the coating takes place. This way, the layer buildup is controlled in continuous alternation with cathodic pulses. The use of simple pulse conditions such as, for example, 1 s current flow ($t_{on}$) and 0.5 s pulse pause ($t_{off}$) at medium current densities leads to homogeneous coatings.

Suitable substrate materials typically used herein are copper base materials such as pure copper, brass, or bronze, iron materials such as iron or stainless steel, nickel, gold, and silver. The substrate materials can also be multilayer systems which have been coated galvanically or with another coating technique. This relates, for example, to circuit board base material or iron materials which have been nickel-plated or copper-plated and then optionally gold-plated or coated with pre-silver. Another substrate material is, for example, a wax core precoated with silver conductive varnish (electroforming).

As has already been indicated, the electrolyte according to the invention is an acidic type. The pH value should be less than or equal to 2 and should not fall below 0.2. The pH value is preferably between 0.5 and 1.5. It may be that fluctuations with regard to the pH value of the electrolyte occur during electrolysis. In one preferred embodiment of the present method, the person skilled in the art therefore proceeds in monitoring the pH value during electrolysis, and if necessary adjusting it to the nominal value. The acids used in the electrolyte are advantageously used for adjusting the pH value.

The temperature prevailing during the deposition of the rhodium-ruthenium metal layer can be selected as desired by the person skilled in the art. Their decision is thereby oriented, on the one hand, toward an adequate deposition rate and applicable current density range, and on the other toward economic aspects or the stability of the electrolyte. It is advantageous to set the temperature to 20° C. to 65° C., preferably 30° C. to 60° C., and particularly preferably 40° C. to 55° C.

When using the electrolyte according to the invention, preference may be given to using insoluble anodes. Preferably used as insoluble anodes are those made of a material selected from the group consisting of platinized titanium, graphite, mixed metal oxides, glassy carbon anodes, and special carbon material (DLC, "diamond-like carbon"), or combinations of these anodes. Insoluble anodes of platinized titanium or titanium coated with mixed metal oxides are advantageous, the mixed metal oxides being preferably selected from iridium oxide, ruthenium oxide, tantalum oxide, and mixtures thereof. Also advantageously used for the implementation of the invention are iridium-transition metal oxide-mixed oxide anodes, more preferably mixed oxide anodes composed of iridium-ruthenium mixed oxide, iridium-ruthenium-titanium mixed oxide, or iridium-tantalum mixed oxide. More information may be found in Cobley, A. J. et al. (The use of insoluble Anodes in Acid Sulphate Copper Electrodeposition Solutions, Trans IMF, 2001,79(3), pp. 113 and 114).

In order to produce optimally dark layers, it is advantageous to perform anodic post-treatment (see EP171091B1 or https://en.wikipedia.org/w/index.php?title=Anodizing&oldid=888700538). This post-treatment known to the person skilled in the art can make the rhodium-ruthenium layer or the layer sequence addressed herein even more abrasion-resistant and blacker. A tendency to form cracks can thus also be counteracted. For anodization, the article produced according to the invention is introduced into the post-treatment solution and anodized (stainless steel cathode).

The invention is described in the following examples.

EXAMPLE 1

An electrolyte according to the invention which, in addition to 1.5 g/l of rhodium [dirhodium trisulfate], also contained 0.5 g/l of ruthenium as $[Ru_2NCl_8(H_2O)_2]^{3-}$, 4 g/l of ethylene diamine tetra (methylene phosphonic acid) EDTMP, and 11 g/l of potassium hydrogen phtalate as a blackening agent in water, and 10 g/l of sulfuric acid, was used for producing black, well-conductive, and abrasion-resistant layers on consumer goods. The temperature of the electrolyte was 45° C.; the pH around 1.0.

In a rack coating process, suitable substrates were finished at a set current density of 0.25 to 5 A/dm$^2$. The obtained layers had very good mechanical stability and exhibited a black, very appealing neutral hue in the color range (a* and b* value).

Figure 2:
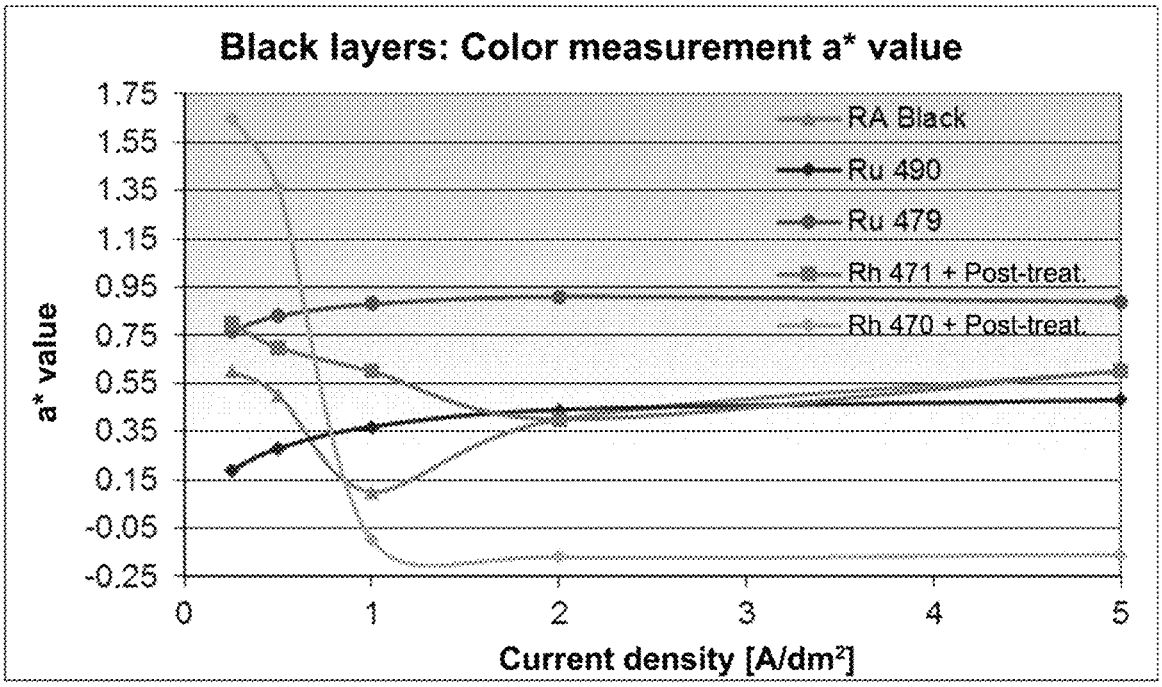
FIG. 2 is a graph showing the a* value of electrolytically deposited metal layers.
Figure 3:
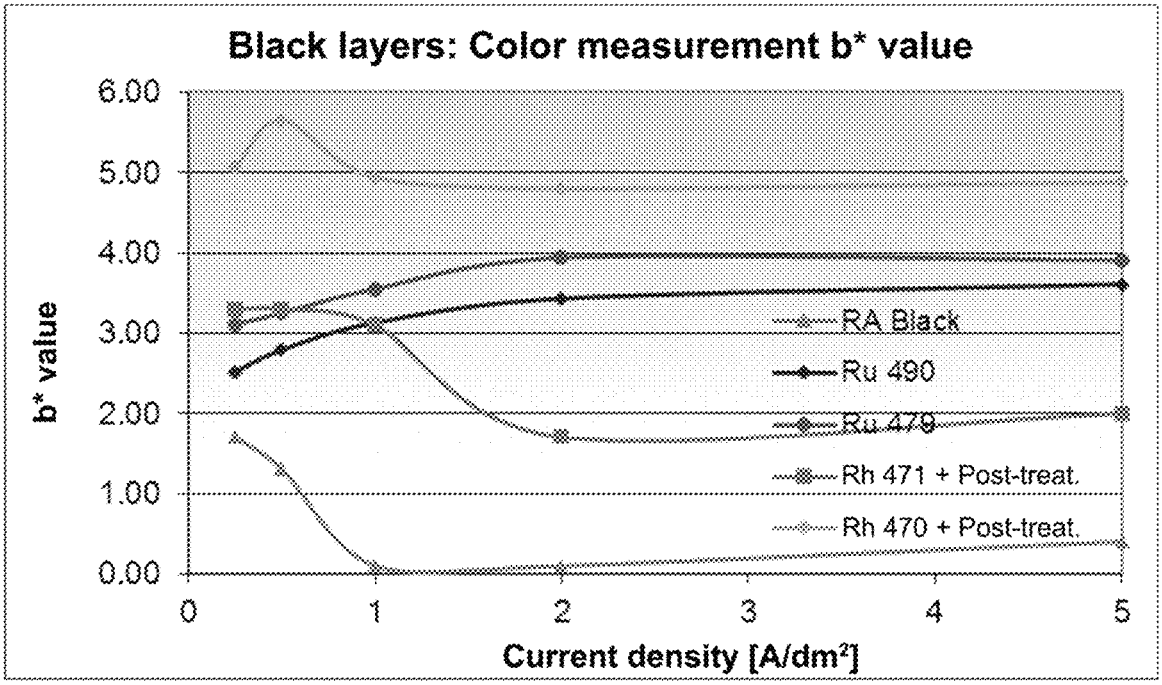
FIG. 3 is a graph showing the b* value of electrolytically deposited metal layers.

The color values are visible in the appended diagrams (FIGS. 1-3). The electrolyte according to the invention is referred to as RA black.

Ruthuna® 490 and Ru 479 are commercially available black ruthenium electrolytes. Rhoduna® 470 and 471 are commercially available black rhodium electrolytes (https://ep.umicore.com/en/products/productfinder).

EXAMPLE 2

An electrolyte according to the invention which, in addition to 1.0 g/l of rhodium [dirhodium trisulfate], also contained 1.0 g/l of ruthenium as $[Ru_2NCl_8(H_2O)_2]^{3-}$, 5 g/l of ethylene diamine tetra (methylene phosphonic acid) EDTMP, and 7.5 g/l of potassium hydrogen phtalate as a blackening agent in water, and 10 g/l of sulfuric acid, was used for producing particularly black and abrasion-resistant layers on consumer goods. The temperature of the electrolyte was 45° C.; the electrolyte had a pH value of about 1.2.

In a rack coating process, suitable substrates were precoated at a set current density of 0.75 to 2 A/dm$^2$. A thin cover layer of a very dark (L*=47) black rhodium electrolyte (e.g. Rhoduna® 470) was then applied. It was anodically post-treated in a solution containing 10 g/l of potassium hydrogen phtalate at 4 volts. The post-dip solution was tempered at 30° C. The obtained layers showed a deep black hue and had very good mechanical stability.

The invention claimed is:

1. An aqueous, acidic electrolyte for producing dark metal layers on conductive materials, comprising:

0.5-15.0 g/l of a soluble rhodium metal;

0.5-10.0 g/l of a soluble ruthenium metal;

5-150 g/l of an acid; and a phosphonic acid and a dicarboxylic acid.

2. The electrolyte according to claim 1, wherein the soluble ruthenium metal is present in the form of a binuclear complex.

3. A method of producing an electrodeposited metal layer on an article, said electrodeposited metal layer comprising rhodium and ruthenium metals in a wt %-based composition of from 40:60 to 90:10, based on the sum of the weights of both metals, the metal layer having an L* value of less than 65 and an a* value of from −3 to +3 according to DIN EN ISO 11664-4 (effective version as of Apr. 8, 2019), which comprises contacting the electrolyte according to claim 1 with the article in the presence of a current thereby depositing the electrodeposited metal layer on the article.

4. The method according to claim 3, wherein the electrodeposited metal layer has a b* value between −7 and +7.

5. The method according to claim 3, wherein the electrodeposited metal layer serves as an underlayer for a first electrodeposited metal layer of rhodium, said first electrodeposited metal layer having a thickness of 0.05-0.5 μm.

6. The method according to claim 5, wherein the L* value of the underlayer and the first electrodeposited metal layer combined is below 50.

7. The method according to claim 3, wherein the electrodeposited metal layer has an abrasion resistance of less than 0.75 μm/1000 strokes as measured by a test known as "the Bosch-Weinmann test".

8. A method for electrodepositing a metal layer on a conductive material, which comprises:

a) contacting the conductive material as a cathode with the aqueous, acidic electrolyte according to claim 1;

b) contacting an anode with the aqueous, acidic electrolyte; and c) establishing a current flow between the cathode and the anode.

9. The method according to claim 8, wherein the current flow has a current density of 0.1-50 $A/dm^2$.

10. The method according to claim 8, wherein the pH value of the aqueous, acidic electrolyte is between 0.2 and 2.

11. The method according to claim 8, wherein the aqueous, acidic electrolyte has a temperature between 20° C. and 65° C.

12. The method according to claim 8, and wherein steps (a)-(c) result in the metal layer, and said method further comprises (d) subjecting the metal layer to an anodic post-treatment.

* * * * *